US007871015B2

(12) United States Patent
Akhtar et al.

(10) Patent No.: US 7,871,015 B2
(45) Date of Patent: Jan. 18, 2011

(54) RAIL JOINT ASSEMBLY USING EMBEDDED LOAD TRANSFER KEYS AND METHOD THEREFOR

(75) Inventors: Muhammad Naeem Akhtar, Pueblo, CO (US); David Daniel Davis, Colorado Springs, CO (US)

(73) Assignee: Transportation Technology Center, Inc., Pueblo, CO (US)

( * ) Notice: Subject to any disclaimer, the term of this patent is extended or adjusted under 35 U.S.C. 154(b) by 320 days.

(21) Appl. No.: 12/250,120

(22) Filed: Oct. 13, 2008

(65) Prior Publication Data

US 2010/0090018 A1 Apr. 15, 2010

(51) Int. Cl.
*E01B 11/00* (2006.01)

(52) U.S. Cl. ..... 238/243; 238/159; 238/250; 238/253; 238/260

(58) Field of Classification Search ..... 238/159, 238/243, 244, 248, 250, 251, 253, 260; 411/531; 403/204, 286, 306
See application file for complete search history.

(56) References Cited

U.S. PATENT DOCUMENTS

| | | | | | |
|---|---|---|---|---|---|
| 1,215,897 | A * | 2/1917 | Ballou | 238/159 |
| 2,036,633 | A * | 4/1936 | Hill | 238/167 |
| 2,116,463 | A * | 5/1938 | Livingston | 238/244 |
| 2,670,136 | A * | 2/1954 | Moses | 238/155 |
| 3,416,728 | A * | 12/1968 | Hamilton, Jr. | 238/152 |
| 3,837,948 | A * | 9/1974 | Nelson et al. | 156/71 |
| 3,952,948 | A * | 4/1976 | Nelson et al. | 238/243 |
| 4,386,736 | A * | 6/1983 | Benkler et al. | 238/159 |
| 5,503,331 | A * | 4/1996 | Uramson et al. | 238/152 |
| 6,832,869 | B2 * | 12/2004 | Lauchner | 403/204 |
| 7,090,143 | B2 * | 8/2006 | Urmson et al. | 238/152 |
| D547,642 | S * | 7/2007 | Urmson et al. | D8/382 |
| 7,735,745 | B2 * | 6/2010 | Igwenezie | 238/159 |
| 7,735,746 | B2 * | 6/2010 | Igwenezie | 238/159 |
| 2006/0027674 | A1 * | 2/2006 | Urmson et al. | 238/243 |
| 2007/0084943 | A1 * | 4/2007 | Roskamp | 238/243 |
| 2007/0272762 | A1 * | 11/2007 | Click et al. | 238/14.05 |
| 2008/0035749 | A1 * | 2/2008 | Igwenezie | 238/243 |
| 2009/0302125 | A1 * | 12/2009 | Urmson et al. | 238/159 |
| 2010/0090018 | A1 * | 4/2010 | Akhtar et al. | 238/159 |
| 2010/0096468 | A1 * | 4/2010 | Igwemezie | 238/159 |

OTHER PUBLICATIONS

Muhammad N. Akhtar et al., Performance Evaluation of Bonded Insulated Joints, Technology Digest, Mar. 2005, pp. 1-4, TD-05-004, USA.

(Continued)

*Primary Examiner*—S. Joseph Morano
*Assistant Examiner*—Jason C Smith
(74) *Attorney, Agent, or Firm*—Dorr, Carson & Birney, P.C.

(57) ABSTRACT

A rail joint assembly joining the ends of two rails together includes a pair of joint bars. Each joint bar having one side configured to the rail web side. Mechanical fasteners mount the joint bars to the web sides. Pairs of load bearing keys are embedded in web counter bores at predetermined depths into the webs and embedded in adjacent joint bar counter bores at predetermined depths into the joint bars. The pairs of keys in the webs and the joint bars transfer railway loads through the joint and substantially strengthen the rail joint assembly.

19 Claims, 7 Drawing Sheets

OTHER PUBLICATIONS

Muhammad Akhtar et al., Development of an Improved Performance Bonded Insulated Joint for HAL Service, Technology Digest, May 2006, pp. 1-4, TD-06-012, USA.
Muhammad N. Akhtar et al., The Effects of Moveable Bridge Joint on the Fatigue Life of Welded Braces of Open Deck Steel Bridge at FAST, Technology Digest, Nov. 2007, pp. 1-4, TD-07-037, USA.
David D. Davis et al., Evaluation of Improved Designs for Bonded Insulated Joints in HAL Service, Technology Digest, Jul. 2007, pp. 1-4, TD-07-020, USA.
David D. Davis, Charity D. Sasaoka and Muhammad N. Akhtar, Special Trackwork Designs for Improved Performance and Reliability under Heavy Axle Load (HAL) Traffic, International Haul Association Conference, 2005, Rio de Janeiro, Brazil.
David D. Davis and Muhammad Akhtar, Reduced Impact Bonded Insulated Joint Designs, Railway Track and Structures, Aug. 2006.
David D. Davis, Muhammad Akhtar, Ed Kokake and Karen Horiszny, Effects of Heavy Axle Loads on Bonded Insulated Joint Performance, american Railway Engineering and Maintenance of Way Association, 2005, Chicago, Illinois.
Muhammad N. Akhtar, David D. Davis and William S. Riehl III, Performance Evaluation of Mechincal Rail Joints, Railway Track and Structures, Jul. 2008.

* cited by examiner

Fig. 3
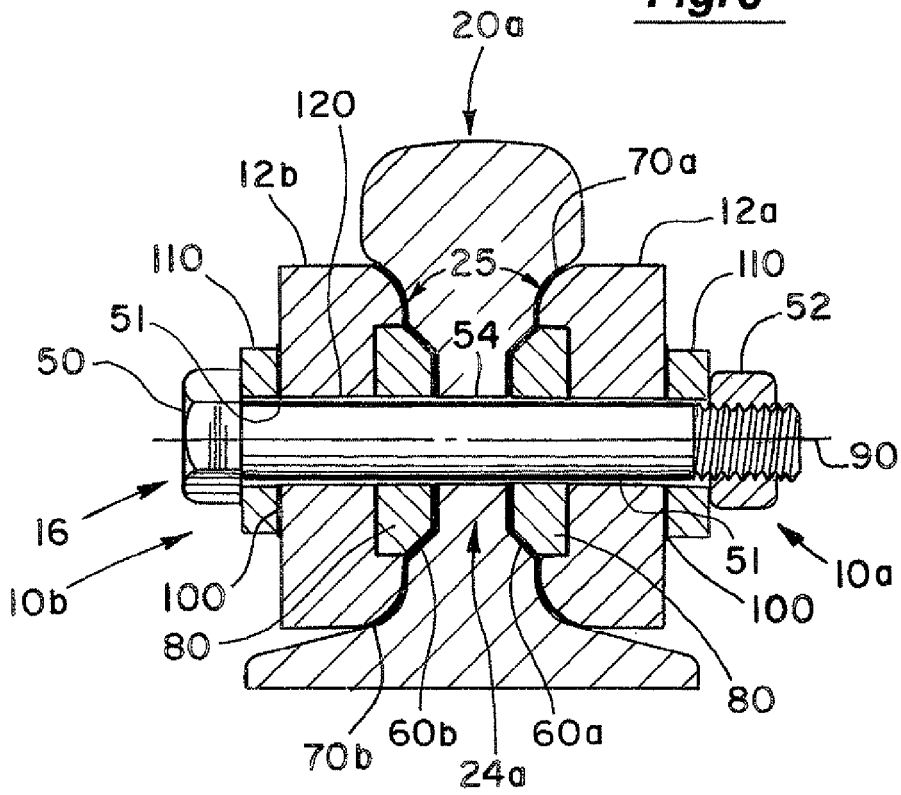
Fig. 5a
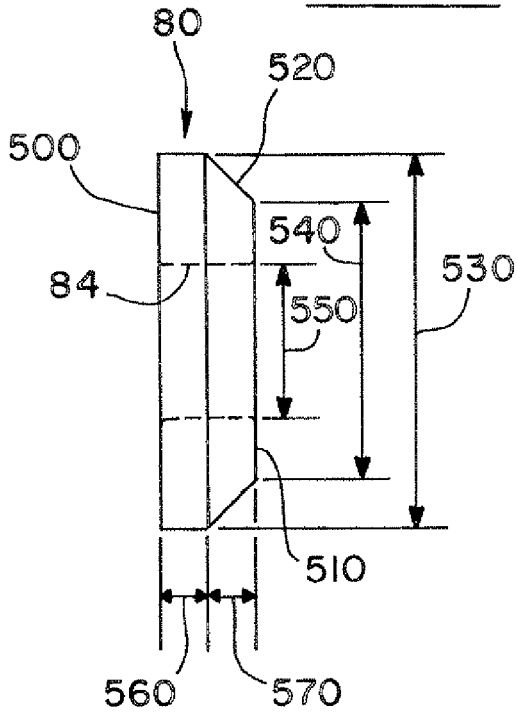
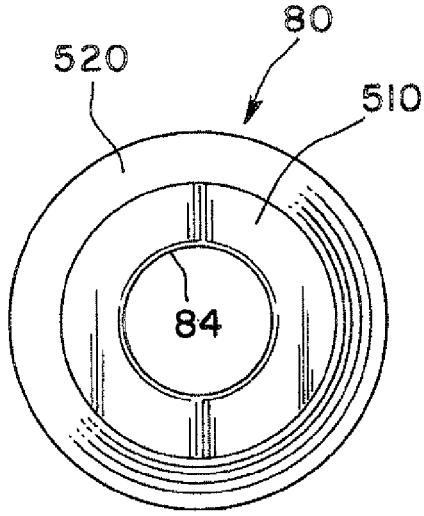
Fig. 5b

RAIL JOINT ASSEMBLY USING EMBEDDED LOAD TRANSFER KEYS AND METHOD THEREFOR

BACKGROUND OF THE INVENTION

1. Field of the Invention

The invention relates to a rail joint assembly for joining rail ends together on railroad track and, more particularly, to a rail joint assembly more efficiently transferring both vertical and longitudinal railway loads through a strengthened rail joint.

2. Discussion of the Background

Early on, railroad operators butted rail ends together and mechanically fastened the rail ends together at the joint with joint bars on each side of the rail held in place by bolts through the web of each rail end.

A need arose to electrically isolate the rail ends from each other for train detection and for traffic control circuits that use the rail as conductors. Insulating adhesives such as epoxy have been used to both strengthen and to electrically isolate the two rail ends. U.S. Pat. No. 3,837,948 sets forth the use of both a thermoplastic adhesive layer which is itself normally electrically insulating to lock the rail ends together and an electrically insulating material such as resin-impregnated cloth. U.S. Design Pat. No. D547,642 shows a wrap-around joint bar sleeve insulator.

A number of prior rail joint designs are directed to approaches that strengthen the rail joint assembly and/or to insulate the two rail ends from each other. For example, U.S. Pat. No. 5,503,331 discloses a series of rail bonding adhesives using embedded nonconductive spacers. U.S. Pat. No. 7,090,143 uses an insulating spacer and a layer of epoxy that is sandwiched between a rail joint bar and the railroad rail. U.S. Patent Publication No. US2007/0272762 A1 (Ser. No. 11/420,199) sets forth joint bars with thicker midsections for use with thick web rail. The thicker midsection of the joint bar provides increased support for the joint at the abutment between the rail segments. U.S. Patent Publication No. US2008/0035749 A1 (Ser. No. 11/570,773) provides stiffener plates mounted to the joint bars such that the joint bars and the web portion of the rails are sandwiched between the stiffener plates.

A continued need exists to improve upon such joint designs because both mechanical and/or insulated joints have a lower service life than the rail itself. Generally insulated joints are replaced five to ten times during the service life of the rail and the resulting cost to replace failed mechanical or insulated joints is expensive. Additional costs are incurred due to service delays and service reliability. Rail joints constitute weak points in the track and are affected by railway loads passing over the joint which provide downward forces on the joint and by temperature variations. Railway loads, especially heavy railway loads, cause adhesive failure, failure of the mechanical fasteners, and failure of the joint bar. Wide swings in temperature also provide thermal stress to the rail joints. Insulated adhesive joints when subjected to such environmental stress and railway loads may lose strength. Such premature failures may cause one or more of the mechanical fasteners to then undergo mechanical stress resulting in shearing or cracking of the fastener.

Continuously welded rail (CWR) is used to eliminate the majority of rail joints, but rail joints, especially insulated rail joints, are still needed. The use of CWR has further increased the longitudinal loading on rail joints. Rail joint designs accommodate rail longitudinal movement by providing a space between the rail ends and oval holes in the joint bars. This space makes the joint less efficient in transferring both vertical and longitudinal loads through the joint. Insulated adhesives and mechanical fasteners are also subject to failure under such longitudinal stress as discussed above for vertical wheel loads.

Mechanical joints and Insulated joints represent two basic joints that act differently in the presence of longitudinal movement. Insulated joints do not allow for rail longitudinal movement and are inadequate to carry high longitudinal forces and high live railway loads. Mechanical joints allow for such longitudinal movement, but are weaker for carrying high vertical railway loads.

Three basic types of failure present in conventional mechanical rail joints are mechanical fastener failure, joint bar failure and rail battering. A fourth basic type of failure for insulated joints is adhesive failure. A need exists to provide a rail joint that more efficiently transfers vertical and longitudinal loads through the rail joint that substantially minimizes mechanical fastener failure, joint bar failure and adhesive failure. A need exists to strengthen a rail joint that approaches, equals, or exceeds the service life of the rail itself by substantially strengthening the rail joint assembly to handle railway load forces and environmental forces well exceeding those present.

An object of the invention is address the above needs by providing a rail joint assembly and method, for use with mechanical joints and insulated joints, having opposing pairs of load bearing keys embedded in both the rail web and in the joint bars that cause the web and the joint bars to integrally strengthen and act together, that effectively transfers vertical and horizontal railway loads through the joint and that intercepts the load path between the web and joint bars to minimize failure.

SUMMARY OF THE INVENTION

A new rail joint assembly for joining the ends of two rails together at a joint is set forth that strengthens the joint against heavy railway loads and that minimizes the effects of environmental stresses on the joint. The new rail joint assembly includes a pair of joint bars with each joint bar having one side configured to the side of the web. Mechanical fasteners mount the joint bars to the web sides of the two rail ends so that the joint bars span across the joint. The configured sides of the joint bars are held against the opposing sides of the webs of the two rail ends. Pairs of load bearing keys are firmly embedded in web counter bores which are formed at predetermined depths on opposite sides of the web of each rail end and in adjacent corresponding joint bar counter bores which are also formed at predetermined depths into the joint bars when the mechanical fasteners mount the joint bars to the webs of the two rail ends. The pairs of opposing embedded keys in each rail web and in the joint bars transfer railway loads through the joint and substantially strengthen the rail joint assembly by intercepting the load path existing between the joint bars and the webs of each rail end.

A novel method for transferring the forces from a moving railway load on a first rail to a second rail through a rail joint assembly is set forth. Moving railway load forces on the first rail at the joint are transferred through a first pair of load bearing keys embedded between the pair of joint bars in the rail joint assembly and on opposite sides of the web of the first rail. The pair of joint bars couples the transferred forces from the first pair of embedded load bearing keys to a second pair of load bearing keys embedded between joint bars and on opposite of the web of the second rail. The coupled forces are then transferred from the second pair of load bearing keys to the second rail. The method can be used with more than one pair of embedded load bearing keys on each rail end.

In both the new rail joint assembly and method summarized above, the load bearing embedded keys being essentially integral with the rail webs and the joint bars substantially strengthens the rail joint assembly to that of the rails or better. The pairs of load bearing keys can be used in either mechanical rail joint assemblies or insulated rail joint assemblies.

The summary set forth above does not limit the teachings of the invention especially as to variations and other embodiments of the invention as more fully set out the following description taken in connection with the accompanying drawings.

BRIEF DESCRIPTION OF THE DRAWINGS

FIG. 3 is a cross-section view taken along section lines 3-3 of FIG. 1.

FIG. 5*a* is a side planar view of the key of the invention.

FIG. 5*b* is a front planar view of the key of the invention.

DETAILED DESCRIPTION OF THE INVENTION

Figure 1:
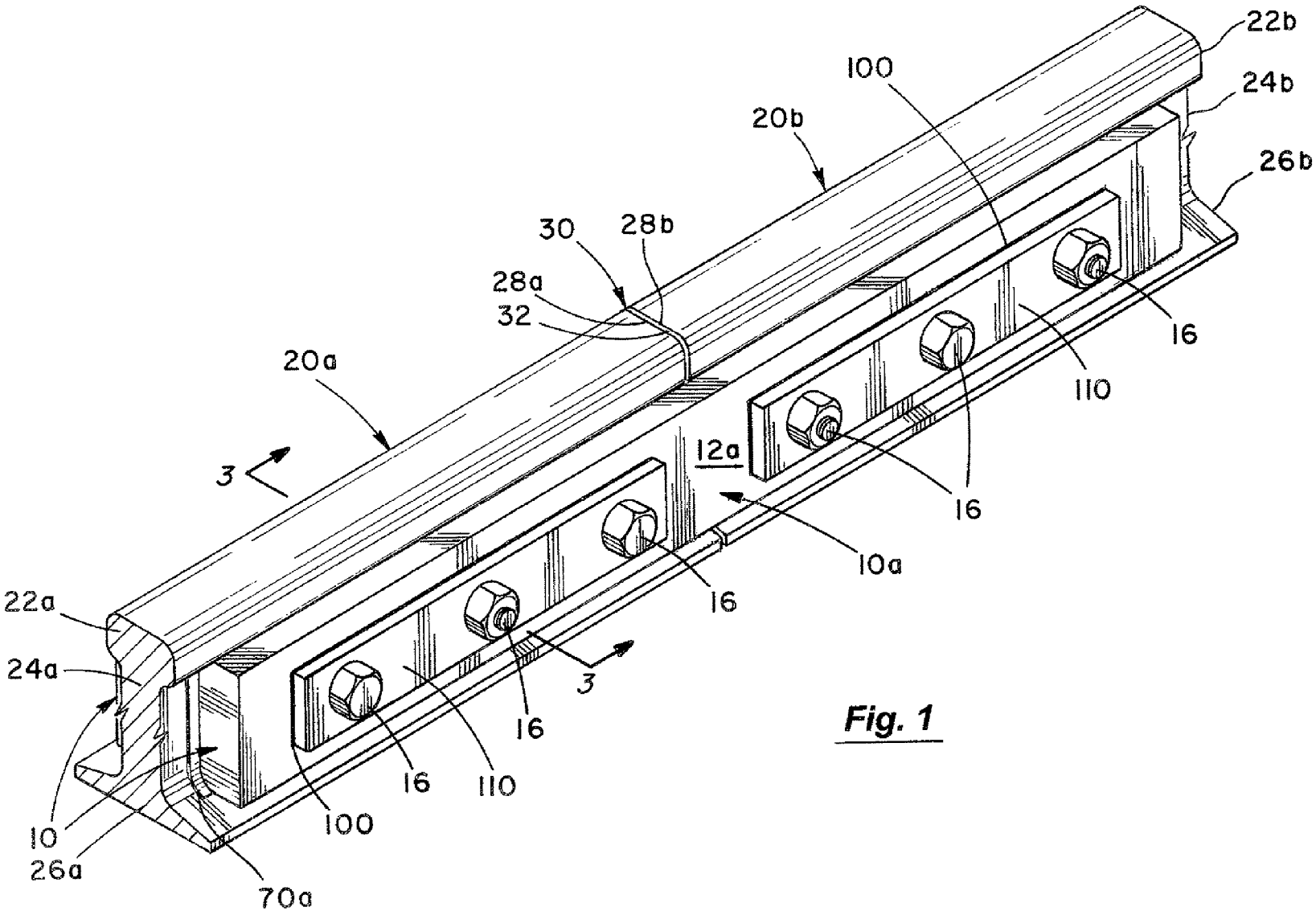
FIG. 1 is a perspective view of the rail joint assembly of the invention joining two thick web rail ends together.

In FIG. 1, the rail joint assembly 10 of the invention is shown joining two rails 20*a* and 20*b* together at a joint 30. This occurs on conventional railroad track (not shown). The rail joint assembly 10 functions to transfer railway load forces on the two rails 20*a* and 20*b* from one rail to the next rail using components that both strengthen the rail joint and minimize component failure therein.

Each rail 20*a* and 20*b* has a head 22*a* and 22*b*, a web 24*a* and 24*b*, a base 26*a* and 26*b*, and an end 28*a* and 28*b*, respectively. The rails 20*a* and 20*b* are conventional and are of a thick web, regular web or any desired web construction. In the embodiment of FIG. 1, the rails 20*a* and 20*b* are identical and a thick web rail is illustrated. At joint 30, a conventional spacer 32 may be inserted between the two ends 28*a* and 28*b*. The spacer 32, in some applications, is an insulator to provide electrical isolation between the two ends 28*a* and 28*b*.

One side 10*a* of the rail joint assembly 10 is shown in FIG. 1; the other side 10*b* is not clearly shown in FIG. 1. Side 10*a* shows a joint bar 12*a* over an insulating layer 70*a*, two conventional washer plates 110 over insulating layers 100, and six conventional mechanical fasteners 16.

In FIGS. 1 through 4 an insulated rail joint assembly 10 is shown. The use of the various insulation components shown is optional and, if not used, a non-insulated mechanical rail joint assembly embodiment of the invention is obtained.

Figure 2:
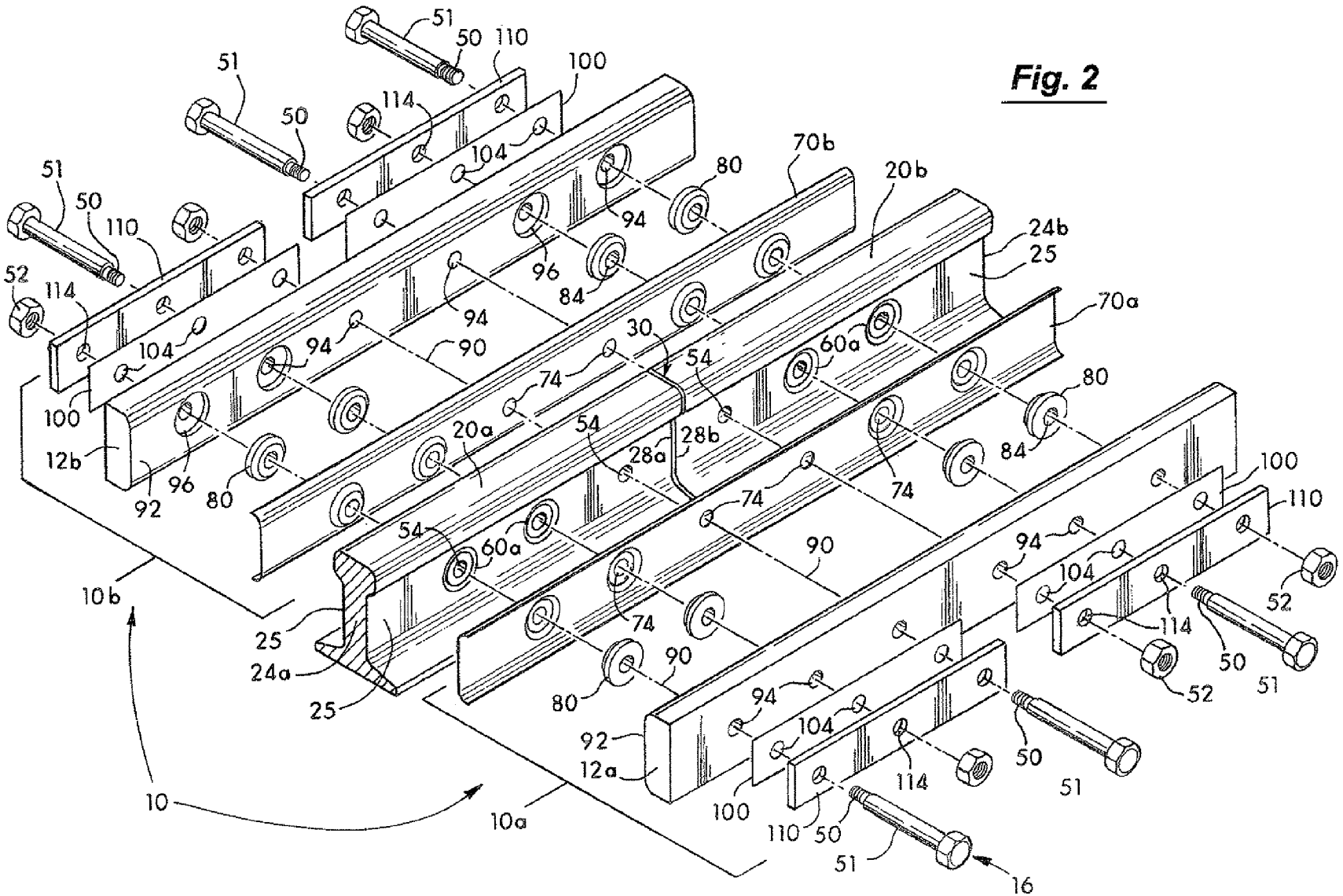
FIG. 2 is an exploded perspective view of FIG. 1.

FIG. 2 illustrates, by way of an exploded view of FIG. 1, the various components of one embodiment of an insulated rail joint assembly 10 of the invention. The rail joint assembly 10, as discussed later, may constitute a number of different embodiments. As an overview, FIGS. 2 through 4 shows that the two sides 10*a* and 10*b* are identical in components and further shows reference numerals that are used on some, but not all of the same components for clarity.

In FIG. 2, the two thick web rails 20*a* and 20*b* are shown with ends 28*a* and 28*b* opposing each other at joint 30. In this embodiment the mechanical fasteners 16 are identical and comprise bolts 50 with nuts 52. Each bolt has an insulating sleeve 51 such as a plastic sleeve cut to the length of the bolt shank to provide for electrical isolation. Three bolt holes 54 are drilled through web 24*a* and three bolt holes 54 are drilled through web 24*b*. The number of bolt holes 54 in each rail 20*a*, 20*b* can be more or less than three. The bolt holes 54 nearest the ends 28*a*, 28*b* of each rail 20*a*, 20*b* are located at least three inches from the joint 30. The use of mechanical fasteners 16 and the location of holes 54 are conventional and may include any suitable fasteners 16 such as, but not limited to pins, etc.

FIG. 3 shows the use of one of the insulated mechanical fasteners 16 (bolt 50, insulating sleeve 51, nut 52) in the rail joint assembly 10 connected to the thick web rail 20*a* along section line 3-3 of FIG. 1. FIG. 4 is the corresponding exploded view.

Figure 4:
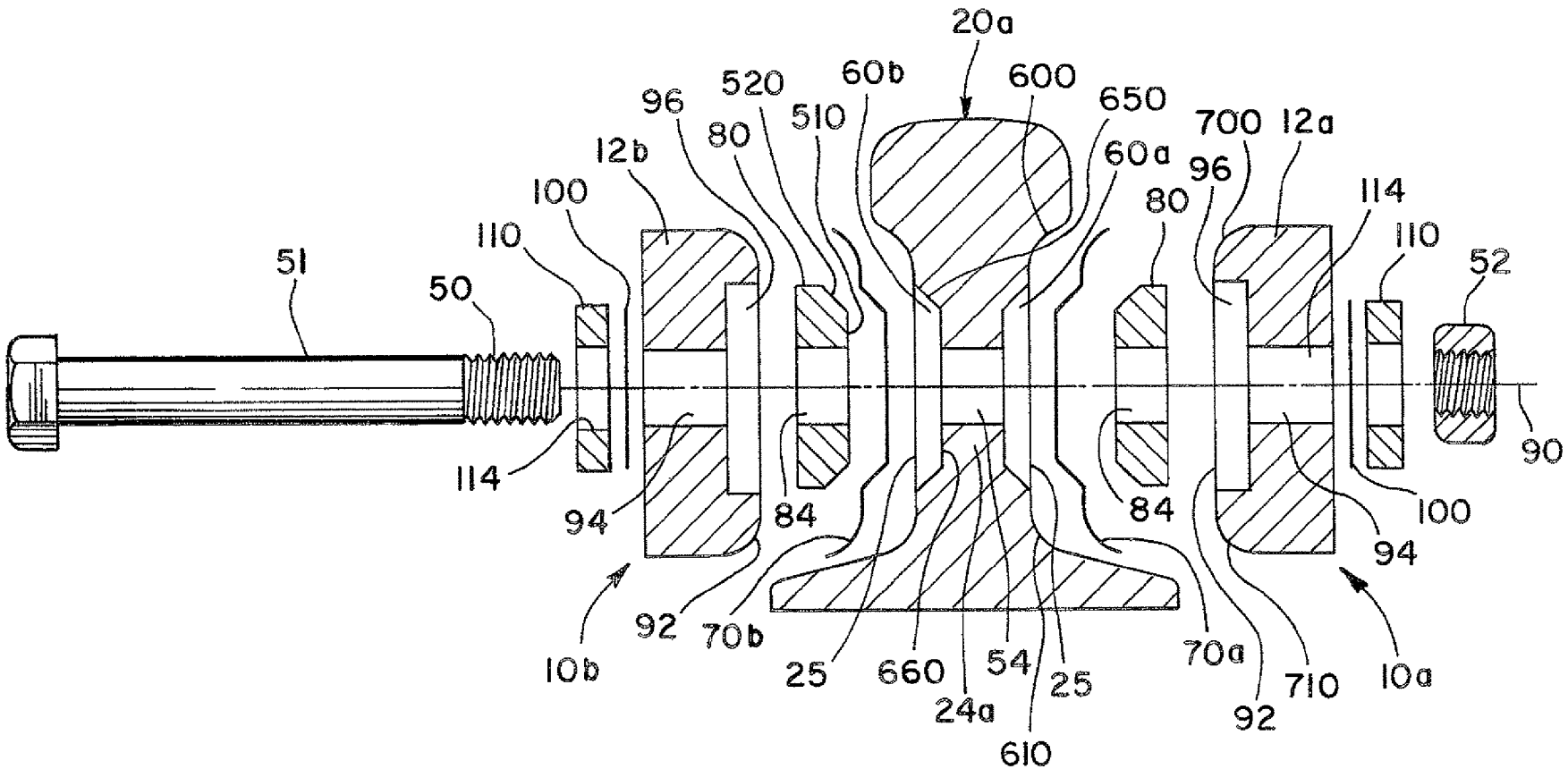
FIG. 4 is an exploded cross-sectional view of the rail joint assembly shown in FIG. 4.

FIGS. 3 and 4 also show one pair of web counter bores {60*a*, 60*b*} formed on opposing sides 25 of web 24*a* by drilling each counter bore 60*a*, 60*b* centered around bolt hole 54 as shown by centerline 90. As shown in FIG. 2, two pairs of opposing web counter bores {60*b*, 60*b*} are formed on each web 24*a*, 24*b* with each pair of web counter bores centered around a bolt hole 54. The bolt holes 54 closest to the joint 30, in this embodiment, do not have a set of web counter bores. Two pairs of directly opposing keys 80, as shown in FIG. 2, are used on each rail end 28*a* and 28*b* for a total of eight individual keys 80 for the rail joint assembly 10 in this embodiment.

The number of pairs of opposing keys 80 on each rail 20*a*, 20*b* can be more or less than two with a resulting change in the number of opposing web counter bore pairs {60*a*, 60*b*}. For example, in one embodiment three pairs of opposing keys 80 can be used with three corresponding pairs of opposing web counter bores on each rail end for a total of twelve keys 80. Or, one pair of opposing keys 80 can be used with one corresponding set of opposing web counter bores on each rail end for a total of four keys 80. In yet another embodiment, pairs of directly opposing keys and opposing counter bores are not used. Rather, a single web counter bore is used on a first bolt hole on one side of the web and a second single web counter bore is used on a second bolt hole on the opposing side of the web so that the pair of keys is used on opposite web sides but with each individual key on a different bolt hole as discussed later with respect to FIG. 9.

As shown in FIG. 3, a key 80 is embedded in both the rail web 24*a* and in a joint bar 12*a*, 12*b*. Embedding a key 80 into the web and the joint bar causes the key to be substantially an integral part of the surrounding web and the surrounding joint bar. Embedding of the key integrally strengthens the joint bar with the web. All the keys 80, the two webs 24*a*, 24*b* and the joint bars 12*a*, 12*b* act together to effectively transfer vertical and horizontal railway loads through the joint.

Each key 80 has a hole 84 formed by drilling which receives the bolt 50 and which is centered along centerline 90 as best shown in FIG. 4.

An adhesive impregnated fiberglass insulator layer 70*a* on side 10*a* (70*b* on side 10*b*) is shown in FIGS. 1 through 4 to provide adhesion and/or electrical isolation. Layers 70*a*, 70*b* are optional and conventionally available. Each layer 70*a*, 70*b* substantially conforms to the shape of the sides 25 of webs 24*a*, 24*b* including the shape of the formed web counter bores 60*a* and 60*b* when installed as shown in FIG. 3. Each layer 70*a*, 70*b* also has a hole 74 formed so as to align with the centerline 90. It is to be understood that any suitable material could be used including, but not limited to a separate layer(s).

A pair of joint bars 12*a* and 12*b* are used to join the two rails 20*a* and 20*b* together at joint 30 as shown in FIGS. 1 through 4. Each joint bar 12*a*, 12*b* has one side 92 substantially configured to the shape of the sides 25 of webs 24*a*, 24*b*. Six bolt holes 94 are formed by drilling through joint bar 12*a* and six bolt holes 94 are formed by drilling through joint bar 12*b* at the locations shown. The number of bolt holes 94 in each joint bar 12*a* and 12*b* can be more or less than six, Four joint bar counter bores 96 are formed by drilling into each of the joint plates 12*a*, 12*b*, as shown, that are centered on four of the six holes 94 at the locations as best shown in FIG. 4. The number and location of joint plate counter bores 96 may vary based on the embodiment of the invention as discussed above for keys 80. As shown in FIG. 3, the holes 94 and the counter bores 96 are centered on line 90. A clearance 120 exists between the sleeve 51 around bolt 50 and each of the formed holes of the washer plate 110, the joint bars 12*a* and 12*b*, and the keys 80. The joint bars 12*a* and 12*b* are made of any suitable material such as high carbon steel or from the steel material that the rail is made of.

Four adhesive impregnated fiberglass insulator layers 100 are shown in the thick web embodiment of FIGS. 1 through 4. Each layer 100 has a formed hole 104 along centerline 90 to receive bolt 50. The layers 100 are optional and in one embodiment are formed of the same material that layers 70*a* and 70*b* are formed from. It is to be understood that any suitable electrically insulated adhesive material could be used.

Four washer plates 110 are also shown in FIGS. 1 through 4. Each washer plate 110 has three formed holes 114 to receive bolts 50 along centerlines 90. The washer plates 110 are conventional.

In summary, FIGS. 1 through 4 illustrate the rail joint assembly 10 used as an insulated joint. With reference to FIG. 3, the bolt 50 with nut 52 when fully engaged against the washer plates 110 holds the joint bars 12*a*, 12*b* against the sides 25 of the web 24*a*, 24*b*. The pair of keys 80 are firmly embedded in the web and joint bar counter bores. The layers 100, 70*a* and 70*b* are squeezed in place and provide not only adhesive strength, but also electrical insulation. Insulating sleeve 51 provides electrical isolation around each bolt shank.

Figure 10:
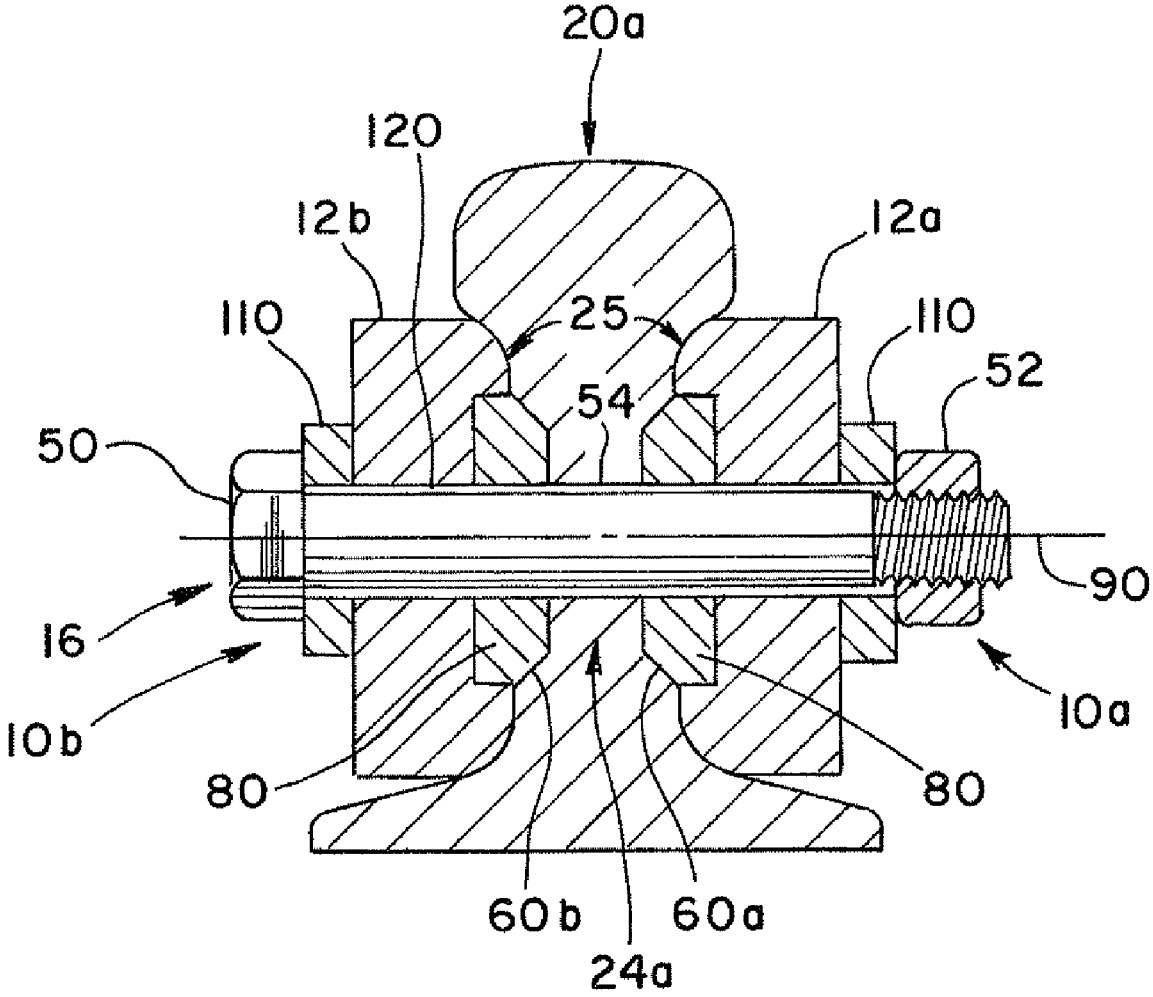
FIG. 10 is a cross-section view of a mechanical rail joint assembly without the electrical insulation of FIG. 3.

FIG. 10 is a cross section of the rail joint assembly used as a mechanical joint without electrical insulation. When the layers 100, 70*a*, and 70*b* and the sleeves 51 are not used, the bolt 50 with nut 52 when fully engaged against the washer plates 110 holds the configured sides 92 of the joint bars against the sides 25 of the web to contain the keys 80 in the web and joint bar counter bores.

In FIGS. 5*a* and 5*b*, the details of the key 80 of the invention are shown for use with a conventional thick web rail. Each key 80 is preferably machined from high carbon steel or from the same steel material that the rail is made of.

The key 80 has a drilled hole 84 for receiving bolt 50 as shown in FIG. 4. The key 80 on side 500 is cylindrical in shape and on side 510 is cone shaped in area 520. In the embodiment shown, the key 80 is circular as shown in FIG. 5*b* and has a first diameter 530 of about three inches and a second diameter 540 of about two and one-quarter inches. The hole 84 diameter 550 is about one and one-quarter inches. The key 80 has a first depth 560 of about three-eights inch and a second depth 570 of about three-eights inch.

Figure 6A:
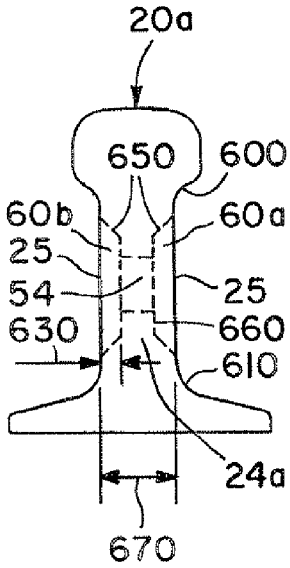
FIG. 6*a* is a side planar view of a portion of the thick web showing the formed web counter bores of the invention.
Figure 6B:
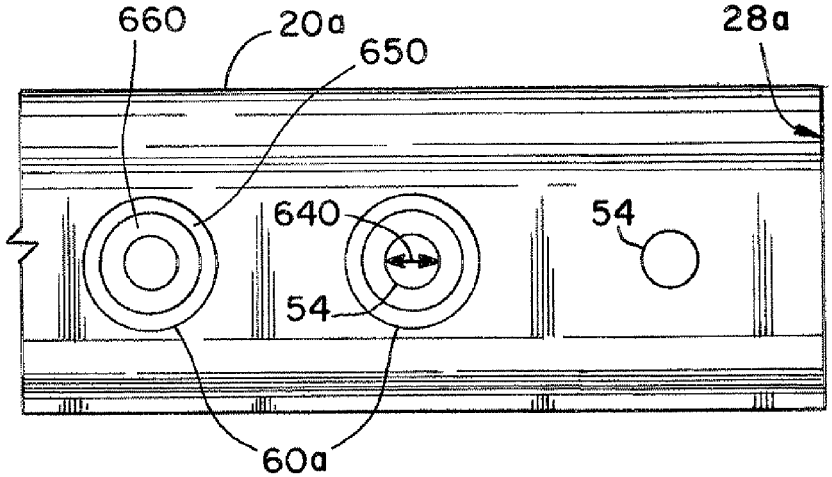
FIG. 6*b* is a front planar view of the thick web of FIG. 6*a*.

The key 80 of FIGS. 5*a* and 5*b* is designed for use with a conventional thick web rail 20*a* shown in FIGS. 6*a* and 6*b*. The rail 20*a* has upper and lower curved edges 600 and 610 on each side 25 of the web 24*a*. The thick web 24*a* has a thickness 670 of about two inches. Holes 54 are conventionally drilled through the web 24*a*. The diameter 640 of the hole is one and one-quarter inches. The web counter bores 60*a* (60*b*) of the invention are machined over the holes 54 shown so that each forms a conical surface 650 and a flat surface 660. The depth 630 of each of the web counter bores 60*a* and 60*b* is about three-eights inch.

In summary, the key 80 has an integral cylindrical portion on side 500 which outwardly extends a predetermined distance at a given diameter. The joint plate counter bore is formed to receive both the given diameter and the predetermined distance so that the cylindrical portion fully embeds into the joint plate counter bore as shown in FIGS. 3 and 10. The key has an integral conical portion on side 510 which outwardly extends the same predetermined distance and has a first diameter that equals the given diameter of the cylindrical portion and a second diameter at the outwardly extending conical shaped end. The web counter bore is formed to receive both the first and second diameters as well as the predetermined distance so that the conical portion fully embeds into the web counter bore as shown in FIGS. 3 and 10. Each key in the pair of keys, when embedded, opposes the other key in the bar on the web on the same formed web hole. The various diameters and the predetermined distances cause the embedded keys to substantially become integral with the adjacent thick web and joint bars.

Figure 7A:
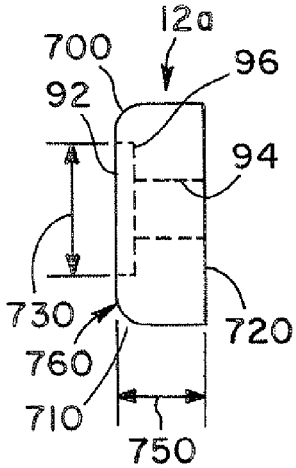
FIG. 7*a* is a side planar view of a portion of the joint bar showing the formed web counter bores of the invention.
Figure 7B:
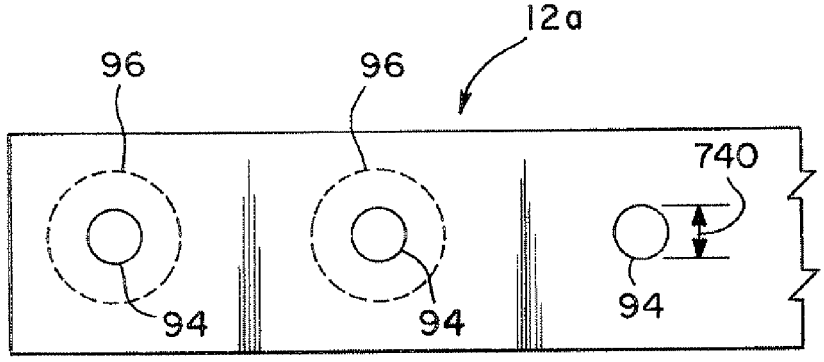
FIG. 7*b* is a front planar view of a joint bar FIG. 7*a*.

FIGS. 7*a* and 7*b* show details of the joint bar 12*a* of FIG. 3. Side 92 is generally configured to mate with the configuration of the outer surface 25 of the web 24*a* as shown in FIG. 3. Side 92 has upper and lower outwardly curved edges 700 and 710 that engage surfaces 600 and 610 when assembled. Side 720 is straight. The joint bar counter bore 96 has a diameter 730 of about three inches and the hole 94 has a diameter 740 of about one and one-quarter inches. The thickness 750 of the joint bar is two inches with a joint bar counter bore 96 depth 760 of about three-eights inch.

The key 80 is dimensioned to have cylindrical side 500 press fitted into the corresponding joint bar counter bore 96 under pressure of a tool to form an integrated structure with the joint bar. For example, the joint bar is heated, the keys are pressed into the corresponding joint bar counter bores, and then the assembly is cooled. Press fitting the load bearing keys into the joint bar embeds the keys thereby resulting in a substantially integral structure.

The dimensions of the key 80 also determine the corresponding dimensions of the web counter bore 60*a* (60*b*). Various tradeoffs exist. The depth 630 of the web counter bore cannot be too shallow as the key 80 must seat in the web counter bore 60*a* (60*b*) to bear and transfer the railway and environmental forces present. Yet, the depth 630 cannot be too large as it will weaken the web. For a conventional thick web of two inches and in the design shown in FIG. 6*a* with an opposing web counter bore on the other side, the depth 630 range is preferably about one-quarter to nine-sixteenths inches. The first and second diameters 530, 540 of the key control the diameters of the web counter bore. If these diameters are too large, the web may weaken. If these diameters are too small, the keys do not bear and transfer the required loads and forces. For both thick and regular webs, a diameter 530 of about three inches is preferable.

The installation of the rail joint assembly 10 of the invention to the rails 20*a* and 20*b* occurs as follows. At the track, the bolt holes and counter bores are drilled into the locations shown near the rail ends 28*a* and 28*b*. Both the joint bars 12*a* and 12*b*, with the keys 80 already press fitted in, are placed against the web sides 25 of the rail ends. The bolts 50 are inserted and the nuts 52 placed on. As the nuts 52 are tightened on the bolts 50, the conical shaped surface 520 of each key 80 seats in the conical shaped surface 650 of each corresponding web counter bore 60*a* (60*b*). The two conical shapes 520 and 650 cooperate to center the key 80 in the web counter bore 60*a* (60b) around the centerline 90 until surfaces 510 and 660 meet. The nuts 50 are then torqued to a suitable value to firmly connect the joint assembly 10 of the invention to the rail ends. In the case of insulated joints, the layers 70*a*, 70*b*, and 100 are installed using insulated sleeves 51 over bolts 50 as shown in FIG. 2 resulting in a completed assembly as shown in FIG. 3.

The keys 80 being embedded on the formed web and joint bar counter bores, as discussed above, cause the web and the joint bars to be an integral part of the surrounding mass of the web, the keys and the joint bars. Together, an embedded key, the web around the formed web counter bore and the area around the formed joint bar counter bore act structurally as a surrounding whole to substantially strengthen the joint, to effectively transfer vertical and horizontal railway loads through the joint and to intercept the load path between the web and joint bars so as to minimize failure.

Figure 8:
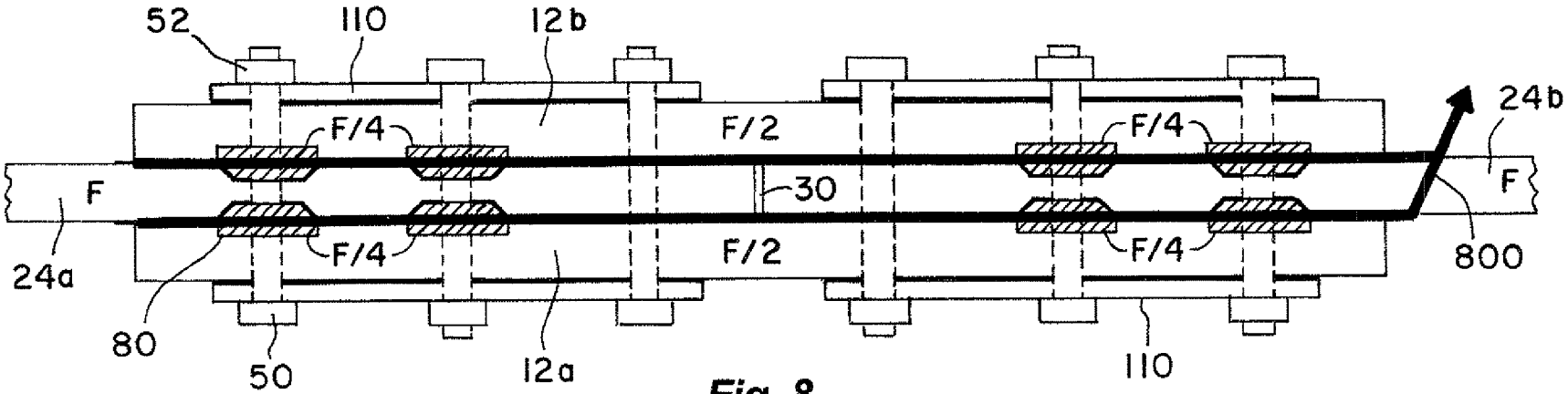
FIG. 8 is an illustration showing the pairs of keys of the invention intercepting the load path through the rail joint assembly.

As shown in FIG. 8, the embedded keys 80 transfer railway loads and environmental forces on rails 20*a* and 20*b* through joint 30. The forces are transferred from the web (e.g., 24*a*) of one rail (e.g., 20*a*), through each embedded key 80 therein, to the joint bars 12*a*, 12*b* connecting with the other rail (e.g., 20*b*) and then, through each embedded key 80 to the web (e.g., 24*b*) of the other rail (e.g., 20*b*). The load path 800 caused by such loads and forces is shown through the rail joint assembly 10 of the invention. The embedded keys 80 intercept this load path 800 and by doing so the keys substantially strengthen the rail joint assembly 10. The rail joint assembly 10 of the invention is capable of resisting approximately four times the railway load that a conventional joint is designed for and is capable of withstanding longitudinal forces of about one million pounds. Environmental forces have little effect on the rail joint assembly of the invention.

The method as set forth herein transfers the railway forces, such as a moving railway load or from thermal stresses, from the end of a first rail to the end of a second rail through the rail joint assembly as set forth in the figures. Railway forces F, as shown in FIG. 8, on the first rail near the joint are transferred through a first two pairs of load bearing keys 80 embedded between the pair of joint bars 12*a*, 12*b* in the rail joint assembly and the web 24*a* of the first rail. Each key 80 embedded in the web 24*b* of the first rail transfers one-fourth of the railway force F. The pair of joint bars 12*a*, 12*b* couples the transferred railway forces from the first two pairs of embedded load bearing keys 80 to a second two pairs of load bearing keys 80 embedded between joint bars 12*a*, 12*b* and the web 24*b* of the second rail. Each joint bar couples one-half of the railway force F. The coupled railway forces are then transferred from the second two pairs of load bearing keys 80 to the second rail. Again, each key 80 embedded in the web of the second rail transfers one-fourth of the railway force F to the web 24*b*. The method can be used with one pair of embedded load bearing keys on each rail end or with more than two pairs of embedded load bearing keys on each rail end.

In both the novel assembly and method disclosed herein, the pairs of load bearing embedded keys are essentially integral with the rail webs and the joint bars. When the embedded pairs of keys act together as a whole with the webs and the joint bars, the resulting integrated structure provides a highly strengthened rail joint assembly.

A number of other embodiments of the rail joint assembly 10 exist based on variations of the teachings set forth above.

Figure 9:
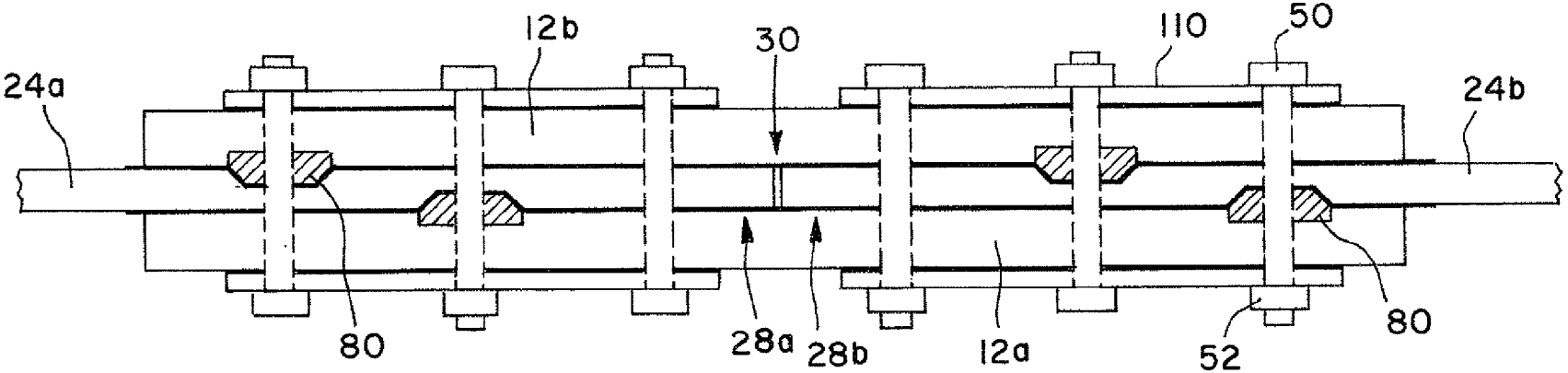
FIG. 9 illustrates the use of the key pairs of the invention on a regular web rail.

In FIG. 9, the use of alternating keys 80 is illustrated for regular web rail which has a thinner web 24*a*, 24*b*. The conventional regular web rail has a web thickness of about 9/16 inch. Keys 80 cannot be place opposite each other on the web without weakening the web. The pairs of keys 80 alternate as shown and the web counter bore depth is about ¼ inch. While two alternating keys are shown, three alternating keys could be used on each end 28*a*, 28*b* at each bolt location.

Some or all of the keys 80 and the corresponding web and joint bar counter bores do not have to be circular in shape, as shown in FIG. 5*b*. The keys can be any desired shape such as, but not limited to oval, elongated, etc. Some or all of the keys 80 and the corresponding web and joint bar counter bores do not have to be aligned with the centerlines of the bolt holes and can be located elsewhere between the web sides and the joint bars. Some or all of the key, counter bore depths do not have to be the same depth. Some or all of the key, counter bore dimensions do not have to be the same dimension. The various designs of the keys and the counter bores of the invention bearing the railway loads can be vigorous.

The above disclosure sets forth a number of embodiments of the invention described in detail with respect to the accompanying drawings. Those skilled in this art will appreciate that various changes, modifications, other structural arrangements, and other embodiments could be practiced under the teachings of the invention without departing from the scope of this invention as set forth in the following claims.

We claim:

1. A rail joint assembly for joining the rail ends of two rails together at a joint, each of said two rails having a web with opposing sides, said rail joint assembly comprising:

a pair of joint bars;

a plurality of mechanical fasteners for mounting, through a corresponding plurality of formed joint bar holes in said pair of joint bars and through a corresponding plurality of formed web holes in said webs of said rail ends, each joint bar in said pair of joint bars on one side of said opposing sides of said webs of said rail ends;

at least one pair of load bearing keys located on each of said rail ends, each key in said at least one pair of load bearing keys embedded in a web counter bore formed in said web a predetermined web distance and in an adjacent corresponding joint bar counter bore formed in said joint bar a predetermined joint bar distance when said plurality of fasteners mount said pair of joint bars to said rail ends.

2. The rail joint assembly of claim 1 wherein each said web counter bore is formed centered around one of said formed web holes, wherein each said joint bar counter bore is formed centered around one of said formed joint bar holes and wherein each key in said at least one pair of load bearing keys has a formed hole to receive one of said plurality of mechanical fasteners.

3. The rail joint assembly of claim 2 wherein said web of each said rail is a thick web and wherein said keys in each at least one pair of load bearing keys directly oppose each other on said thick web on the same formed web hole.

4. The rail joint assembly of claim 2 wherein said web of each said rail is a regular web and wherein said keys in each at least one pair of load bearing keys are located at different formed web holes on said regular web.

5. The rail joint assembly of claim 1 further comprising:

an adhesive layer between each joint bar in said pair of joint bars and said one side of said opposing sides of said webs of said rail ends.

6. The rail joint assembly of claim 1 further comprising:

an insulation layer between each joint bar in said pair of joint bars and said one side of said opposing sides of said webs of said rail ends.

7. The rail joint assembly of claim 1 wherein each of said plurality of mechanical fasteners has electrical insulation isolating said plurality of mechanical fasteners from said rail ends.

8. The rail joint assembly of claim 1 further comprising:

a plurality of washer plates, each of said plurality of washer plates between each said joint bar in said pair of joint bars and at least one of said plurality of mechanical fasteners.

9. The rail joint assembly of claim 8 further comprising:

an electrical insulation layer between each said washer plate in said plurality of washer plates and each said joint bar in said pair of joint bars.

10. A rail joint assembly for joining the rail ends of two rails together at a joint, each said rail in said two rail ends having a thick web with opposing sides, said rail joint assembly comprising:

a pair of joint bars, each joint bar in said pair having one side configured to one of said opposing sides of said thick web;

at least one pair of load bearing keys located on each of said rail ends, each key in said pair having a formed key hole;

a plurality of mechanical fasteners for mounting, through a corresponding plurality of formed joint bar holes in said pair of joint bars, through a corresponding plurality of formed web holes in said thick web of each of said rail ends and through said formed key holes, said configured sides of said pair of joint bars against said opposing sides of said thick webs of said two rail ends;

a plurality of washer plates, each of said plurality of washer plates between said opposing joint bars and said at least one mechanical fastener;

each key in said pair embedded in a corresponding web counter bore formed around one of said formed web holes and in an adjacent corresponding joint bar counter bore formed around one of said formed joint bar holes in said joint bar wherein each said key in said pair opposes the other key in said pair on said thick web on the same formed web hole.

11. The rail joint assembly of claim 10 wherein each said key in said pair comprises:

a cylindrical portion integrally formed on one side of said key, said cylindrical portion having a diameter, said cylindrical portion extending outwardly a predetermined distance, said joint bar counter bore formed to receive said cylindrical portion diameter and said predetermined distance so that said cylindrical portion embeds into said joint bar counter bore;

a conical portion integrally formed on the other side of said key, said conical portion having a first diameter equal to said cylindrical portion diameter and a second diameter at the outwardly extending end of said conical portion, said conical portion having a depth that extends into said corresponding web counter bore said predetermined distance, said web counter bore formed to receive the aforesaid first and second diameters and said predetermined distance so that said conical portion embeds into said web counter bore.

12. The rail joint assembly of claim 11 wherein said cylindrical portion of said key press fits into said joint bar counter bore.

13. The rail joint assembly of claim 10 wherein each of said plurality of mechanical fasteners comprises:

a bolt, a nut.

14. The rail joint assembly of claim 13 wherein the clearance between said bolt and said corresponding formed web hole in said thick web is greater than the clearance between each said embedded key and its corresponding formed counter bore in said thick web.

15. The rail joint assembly of claim 13 wherein each of said plurality of mechanical fasteners further comprises:

an insulating sleeve around said bolt.

16. The rail joint assembly of claim 10 further comprising:

an adhesive layer connecting each joint bar in said pair of joint bars and one side of said opposing sides of said thick webs of said rail ends.

17. The rail joint assembly of claim 16 wherein said adhesive layer provides electrical isolation.

18. The rail joint assembly of claim 17 further comprising:

a layer between said washer plate and said joint bar for providing electrical isolation.

19. A method for transferring railway forces near the end of a first rail to near the end of a second rail through a rail joint assembly, the rail joint assembly having a pair of joint bars connected through the webs of the first and second rails together between the first rail end and the second rail end, the first and second rails each having a web, the method comprising: transferring the railway forces on the first rail to a first at least one pair of load bearing keys embedded between the pair of joint bars and the web of the first rail; coupling the transferred railway forces from the first at least one pair of embedded load bearing keys through the pair of joint bars to a second at least one pair of load bearing keys embedded between the pair of joint bars and the web of the second rail; each key in said at least one pair of load bearing keys embedded in a web counter bore formed in said web a predetermined web distance and in an adjacent corresponding joint bar counter bore formed in said joint bar a predetermined joint bar distance, transferring the coupled railway forces from the second at least one pair of load bearing keys to the second rail.

* * * * *